US006095900A

United States Patent [19]

Fruitman et al.

[11] Patent Number: 6,095,900

[45] Date of Patent: Aug. 1, 2000

[54] METHOD FOR MANUFACTURING A WORKPIECE CARRIER BACKING PAD AND PRESSURE PLATE FOR POLISHING SEMICONDUCTOR WAFERS

[75] Inventors: Clinton O. Fruitman, Chandler; Thomas K. Crosby, Gilbert; James Schlueter, Phoenix, all of Ariz.

[73] Assignee: Speedfam-IPEC, Chandler, Ariz.

[21] Appl. No.: 09/276,983

[22] Filed: Mar. 26, 1999

Related U.S. Application Data

[62] Division of application No. 09/046,325, Mar. 23, 1998.

[51] Int. Cl.[7] ..... B24B 41/06; B24B 1/00

[52] U.S. Cl. ..... 451/28; 451/364; 451/294; 451/41; 451/28; 156/307.1

[58] Field of Search ..... 451/390, 364, 451/397, 398, 384, 288, 287, 41, 28; 156/307.1, 306.6, 537

[56] References Cited

U.S. PATENT DOCUMENTS

| | | |
|---|---|---|
| 3,731,435 | 5/1973 | Boettcher et al. . |
| 3,841,031 | 10/1974 | Walsh . |
| 3,842,544 | 10/1974 | Paola . |
| 4,132,037 | 1/1979 | Bonora . |
| 4,141,180 | 2/1979 | Gill, Jr. et al. . |
| 4,221,083 | 9/1980 | Carroll . |
| 4,258,508 | 3/1981 | Wilson et al. . |
| 4,319,432 | 3/1982 | Day . |
| 4,519,168 | 5/1985 | Cesna . |
| 4,811,522 | 3/1989 | Gill, Jr. . |
| 4,918,869 | 4/1990 | Kitta . |
| 5,101,602 | 4/1992 | Hashimoto . |
| 5,157,877 | 10/1992 | Hashimoto . |
| 5,205,082 | 4/1993 | Shendon et al. . |
| 5,232,875 | 8/1993 | Tuttle et al. . |
| 5,329,732 | 7/1994 | Karlsrud et al. . |
| 5,335,457 | 8/1994 | Matsuda et al. . |
| 5,409,770 | 4/1995 | Netsu et al. . |
| 5,534,053 | 7/1996 | Payne et al. . |
| 5,538,465 | 7/1996 | Netsu et al. . |
| 5,573,448 | 11/1996 | Nakazima et al. . |
| 5,624,299 | 4/1997 | Shendon . |
| 5,791,975 | 8/1998 | Cesna et al. . |
| 5,913,719 | 6/1999 | Hasegawa et al. . |

FOREIGN PATENT DOCUMENTS

| | | |
|---|---|---|
| 0786803 | 7/1997 | European Pat. Off. . |

*Primary Examiner*—Timothy V. Eley
*Assistant Examiner*—Willie Berry, Jr.
*Attorney, Agent, or Firm*—Snell & Wilmer L.L.P.

[57] ABSTRACT

A carrier for semiconductor wafers to be polished comprises a backing pad vulcanized to a pressure plate. The backing pad is formed of a rubber material such as neoprene, SBR or natural rubber. An adhesive film of a thermosetting, thermally reactive material forms an integral bond between the backing pad and pressure plate. The backing pad, adhesive film and pressure plate together comprise a nearly ideally elastic assembly. The exposed face of the backing pad is profiled to a desired profile without effecting crumbling of the rubber material.

6 Claims, 1 Drawing Sheet

METHOD FOR MANUFACTURING A WORKPIECE CARRIER BACKING PAD AND PRESSURE PLATE FOR POLISHING SEMICONDUCTOR WAFERS

This application is a divisional application of U.S. patent application Ser. No. 09/046,325, filed Mar. 23, 1998 and entitled "BACKING PAD FOR WORKPIECE CARRIER".

TECHNICAL FIELD

The present invention relates generally to the art of polishing and planarizing workpieces such as semiconductor wafers, and more particularly, relates to an improved backing pad for a wafer carrier.

BACKGROUND OF THE INVENTION

A flat disk or "wafer" of single crystal silicon is the basic substrate material in the semiconductor industry for the manufacture of integrated circuits. Semiconductor wafers are typically formed by growing an elongated cylinder or ingot of single crystal silicon and then slicing individual wafers from the cylinder. Multiple layers of conductive material and dielectric material are thereafter built up on the wafer in order to form a multilevel integrated circuit.

The front face of the wafer on which integrated circuitry is to be constructed must be extremely flat in order to facilitate reliable semiconductor junctions with subsequent layers of material applied to the wafer. The removal of projections and other imperfections is referred to in the art as planarization. Material layers applied to the wafer as integrated circuitry is built must also be planarized in order to produce extremely flat surfaces free of irregularities or projections. To this end, chemical mechanical polishing ("CMP") machines have been developed, and are well known in the art, to provide controlled planarization of semiconductor wafers and layers deposited thereon.

CMP machines generally include one or more wafer carriers or "chucks" which retain and carry wafers to be planarized and which press the front faces of the wafers against the surface of a rotating polishing pad. The wafer carrier is also typically rotated to effect relative lateral motion between the polishing pad and wear and planarization of the wafer face due to frictional contact against the pad. An abrasive slurry, such as a colloidal silica slurry, is usually introduced at the pad-wafer interface in order to augment the planarization process.

A typical wafer carrier includes a rigid pressure plate and a flexible backing pad secured thereto. The rear face of the wafer is mounted against the backing pad, while the front face of the wafer is exposed to the polishing pad. The backing pad serves several important functions. It cushions the wafer and protects it against damage which may result from direct contact with the rigid pressure plate. Moreover, as downward pressure is applied by the pressure plate to press the wafer against the polishing pad, imperfections or asperities present on the rear face of the wafer are "telegraphed" through the wafer to its front face, resulting in uneven pressure distribution across the wafer front face against the pad which, in turn, leads to uneven material removal rates and impaired planarization. The backing pad acts to absorb any imperfections or asperities present on the rear face of the wafer to prevent uneven pressure distributions and corruption of the planarization process from occurring. Finally, the pad frictionally engages the rear surface of the wafer, thereby preventing movement or sliding of the wafer relative to the backing pad.

Maintenance of a uniform and consistent pad profile or shape is critical to achieving uniform wear across the wafer as it is being polished. Inconsistencies, nonuniformities and deformations in the pad are telegraphed to the front face of the wafer in the same fashion that asperities on the rear face are telegraphed. Many known backing pads are inadequate in this regard as they are formed from materials, such as urethane elastomers, that are characterized by behavior that is plastic as well as elastic. U.S. Pat. No. 4,319,432 to Day, for example, discloses use of urethane backing pads. U.S. Pat. No. 4,811,522 to Gill, Jr. discloses use of a porometric film deformable to such an extent that it is subject to a 40 to 60 percent reduction in its original thickness. Contact adhesives used to bond the pads to the carrier further complicate the plastic behavior as they also move and deform over time. The plasticity of the pads and the adhesive layers leads to permanent strain or deformation of the pad under repeated shear and compressive loads. High stress applications, such as the polishing of tungsten layers applied to wafers, causes even more rapid and serious deterioration of wear uniformity due to plastic deformation of the backing pad. Resins such as urethane are also hydrophillic and their properties can change over time and with chemical exposure.

Backing pads of porous materials are also frequently utilized. Examples of such pads abound in the art and may be found in U.S. Pat. No. 3,841,031 to Walsh; U.S. Pat. No. 4,258,508 to Wilson et al.; U.S. Pat. No. 4,519,168 to Cesna; U.S. Pat. Nos. 5,101,602 and 5,157,877 to Hashimoto; and U.S. Pat. No. 5,538,465 to Netsu et al. These pads have been problematic in that they often become loaded with abrasive buildup from the slurry. As the pad is repeatedly used, its profile changes due to the presence and action of the abrasive. This also results in nonuniform wear patterns on the wafers that become progressively worse as the pad profile continues to change.

U.S. Pat. No. 4,132,037 to Bonora and U.S. Pat. No. 5,335,457 each mention the possibility of using a backing pad formed of silicone rubber. Though alleviating plastic deformation, silicone rubbers have been found to be not suitable in backing pad applications as they are extremely slippery when wet and coated with fine slurry particles and do not provide sufficient friction or surface adhesion between the wafer and pad. The wafer tends to move in the planar direction during polishing and non-uniform material removal rates result.

Many known backing pads are also secured to the pressure plate through use of a separate and deformable adhesive layer. The adhesive layer presents another opportunity for introduction of particles or other imperfections into the stack above the wafer which may impair planarization. U.S. Pat. No. 4,132,037 to Bonora, for example, uses transfer tape to secure the backing bad; U.S. Pat. No. 4,141,180 to Gill, Jr. et al. employs an adhesive; and U.S. Pat. No. 5,205,082 to Shendon et al. utilizes glue. Bonora, in addition to using an adhesive, uses a multi-layer backing pad, the layers of which are also secured together by adhesives. Use of adhesives is also problematic in that the adhesives tend to move and deform under load in a plastic fashion, thereby altering the profile of the pad.

SUMMARY OF THE INVENTION

The present invention provides a workpiece carrier and backing pad which addresses and resolves the shortcomings of the prior art described above.

In accordance with the present invention, a workpiece carrier for carrying a workpiece to be planarized is provided comprising a rigid pressure plate and a flexible backing pad integrally bonded to the plate. The pad is formed of a single layer of an almost ideally elastic rubber material which provides adequate frictional engagement between a workpiece carried by the carrier and the pad. The rubber material is preferably neoprene, SBR or natural rubber, and the backing pad is preferably vulcanized to the pressure plate with an integral, thermosetting adhesive layer.

Also in accordance with the present invention, a method is provided for fabricating a workpiece carrier. The method includes the steps of providing a carrier housing having a rigid pressure plate for applying pressure to the workpiece; integrally bonding a single layer of rubber material to the pressure plate; and planarizing an exposed face of the rubber material to a desired flatness without effecting crumbling of the rubber material.

These and other aspects of the present invention are described in full detail in the following description, claims and appended drawings.

BRIEF DESCRIPTION OF THE DRAWINGS

The present invention will hereinafter be described in conjunction with the appended drawing figures, wherein like numerals denote like elements, and.

DETAILED DESCRIPTION OF PREFERRED EXEMPLARY EMBODIMENTS

The subject invention relates generally to polishing workpieces such as semiconductor wafers. It will be understood, however, that the invention is not limited to a particular workpiece type or to a particular manufacturing or polishing environment.

Figure 1:
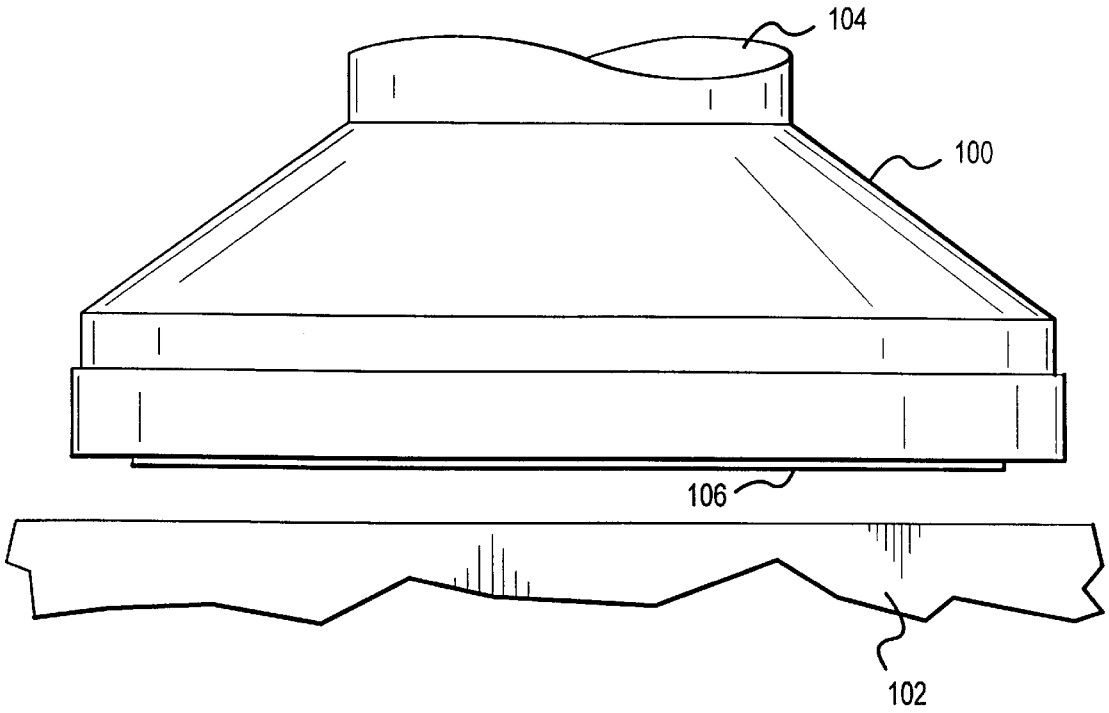
FIG. 1 is a side view of a wafer carrier mounted above a polishing pad.

FIG. 1 depicts in simplified fashion a wafer carrier 100 mounted above a polishing pad 102. Carrier 100 and pad 102 may be integral components of a chemical mechanical polishing machine or any another suitable wafer polishing apparatus. Chemical mechanical polishing machines are well known in the art; a detailed description of their construction and operation may be found in U.S. Pat. No. 5,329,732 to Karlsrud et al., the disclosure of which is incorporated herein by reference.

Carrier 100 is supported and suspended above pad 102 by drive shaft 104. Shaft 104 imparts upward and downward movement to carrier 100 through, for example, the use of an air cylinder; and also imparts rotational movement to carrier 100 through, for example the use of a servo motor. Carrier 100 is constructed to evenly distribute downward pressure from shaft 104 to a wafer 106 carried by carrier 100. Typically, positive and vacuum pressures are also applied through shaft 104 to carrier 100 to release or retain wafer 106.

Polishing pad 102 is mounted below carrier 100 on a rotatable polishing wheel (not shown). Typically, pad 102 is a blown polyurethane, such as the IC and GS series of pads available from Rodel Products Corporation of Scottsdale, Ariz. The hardness and density of pad 102 is selected based on the type of material to be planarized. An abrasive slurry, such as an aqueous slurry of silica particles, is typically pumped onto the pad during polishing operations. The relative movements of carrier 100 and pad 102, augmented by the abrasive action of the slurry, produce a combined chemical and mechanical process at the exposed face of wafer 106 which removes projections and irregularities and produces a substantially flat or planar surface.

Figure 2:
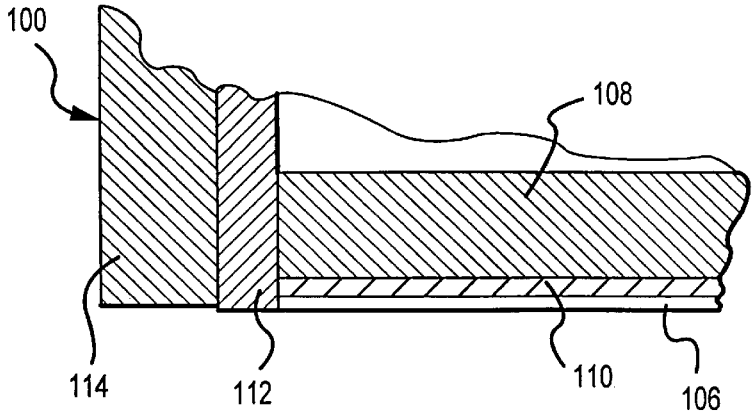
FIG. 2 is an exploded partial sectional view of the wafer carrier of FIG. 1 showing a backing pad adhered to a pressure plate in accordance with the present invention.

With reference to FIG. 2, carrier 100 includes a rigid pressure plate 108 to which is integrally bonded a flexible backing pad 110. Plate 108 and pad 110 may have vacuum holes (not shown) formed therethrough in a known fashion to permit application of vacuum pressure to wafer 106. Plate 108 and pad 110 are surrounded by inner retaining ring 112. A pocket for receipt of wafer 106 is defined between ring 112 and backing pad 110. The rear face of wafer 106 rests in parallel contact against backing pad 110, while the front face of wafer 106 is exposed for parallel contact against the top surface of polishing pad 102. Carrier 100 may also include an outer retaining ring 114. Ring 112 is typically vertically movable relative to ring 114 to permit the wafer retention portion of carrier 100 to "float" relative to outer ring 114. As the configuration and composition of backing pad 110 and pressure plate 108 are the primary subjects of the present invention, the remaining structural details of carrier 100 are not shown or described in detail herein. Many and varied examples of suitable wafer carrier configurations may be found in the prior art.

It is important that backing pad 110 be sufficiently compressible and flexible to cushion wafer 106, as well as to absorb asperities or particulate matter present on the rear face of wafer 106 which might otherwise be telegraphed to the front face of wafer 106. Maintenance of a uniform and consistent profile and shape of backing pad 110, however, is equally important to achieving uniform wear across wafer 106 as it is being polished. Backing pad 110 is exposed to compressive stress from both wafer vacuum and downward force, as well as to shear stress from wafer and pad motion during polishing. Inconsistencies and deformities in the profile of pad 110 created by such stresses are telegraphed to the front face of wafer 106 in the same fashion that asperities on its rear face are telegraphed. It is also important that the backing pad assembly exhibit almost ideally elastic behavior in order to avoid cumulative buildup of pad profile changes that would otherwise disrupt the planarity and uniformity of the polished wafer surface.

To accommodate these conflicting interests, backing pad 110 is formed of an almost perfectly elastic material, such as a chemically stable rubber, which cushions the rear face of wafer 106 against plate 108 and absorbs asperities and imperfections, but which does not deform in a plastic fashion. In this manner, wafer wear uniformity is not influenced by backing pad deformation. The rubber material must also possess sufficient frictional characteristics to prevent relative movement or sliding between the wafer and the pad.

The rubber material is pressed into a film and cut into a backing pad shape. A thermosetting, thermally reactive adhesive film formed of a material exhibiting almost perfectly elastic behavior is applied between pad 110 and plate 108. Pad 110 and plate 108 are then integrally bonded through use of vulcanization (curing by pressure and heat). Finally, the exposed backing pad face is profiled, such as through use of a dry abrasive affixed to a conventional lapping wheel, to achieve a desired profile.

The bond formed between the backing pad and pressure plate is "integral" in that the thermoset adhesive film is cross-linked to both the plate and the rubber. In a sense, the thermoset film becomes an integral part of both the adjacent vulcanized pad and plate. The elastic and integral nature of the bond eliminates problems such as plastic deformation seen in prior art use of adhesives.

Seven rubbers, each of which is available from R.E. Darling Co., Inc. of Tucson, Ariz., were tested for use as a backing pad material: EPDM, nitrile, neoprene, SBR, zeon, viton and natural rubber. Each of these rubbers was formed into a backing pad, bonded via vulcanization to a backing plate and then profiled. Unexpectedly, the effects of the profiling process were the critical factor in selection of an effective backing pad material.

Four of the rubbers failed during the profiling process: EPDM (Durometer Shore A Hardness of 60), nitrile (Durometer Shore A Hardness of 65), zeon (Durometer Shore A Hardness of 82) and viton (Durometer Shore A Hardness of 65). Each of these rubbers experienced crumbling at the edges of the pad during profiling, rendering them unsuitable for use as a backing pad. Neoprene, SBR and natural rubber, conversely, survived the profiling process intact and were extremely effective in polishing operations. These three rubbers, accordingly, are the preferred materials for backing pad 110. Neoprene, having a Durometer Shore A Hardness of 67, was profiled for 58 minutes and during wafer polishing achieved a material removal rate of 4965 angstroms/minute and a planarity nonuniformity of 4.0%, wherein "nonuniformity" refers to the standard deviation of any layer of film thickness across an integrated circuit wafer after polishing. SBR, having a Durometer Shore A Hardness of 60, was profiled for 34 minutes and during wafer polishing achieved a material removal rate of 4895 angstroms/minute and a planarity nonuniformity of only 2.8%. Natural rubber, having a Durometer Shore A Hardness of 60, was profiled for 129 minutes and during wafer polishing achieved a material removal rate of 5603 angstroms/minute and a planarity nonuniformity of only 1.13%.

Although the foregoing description sets forth several preferred exemplary embodiments of the invention, the scope of the invention is not limited to these specific embodiments. Modification may be made to the specific form and design of the described embodiments without departing from the scope of the invention as expressed in the following claims.

What is claimed is:

1. A method for fabricating a workpiece carrier for carrying a workpiece to be planarized comprising the following steps:

providing a carrier housing having a rigid pressure plate for applying pressure to said workpiece;

directly bonding a backing pad comprising a single layer of rubber material to said pressure plate such that said backing pad will be available for receiving a semiconductor wafer; and profiling an exposed face of said backing pad to a desired profile without effecting crumbling of said backing pad.

2. A method as claimed in claim 1, where in said backing pad comprising a single layer of rubber material is vulcanized to said pressure plate.

3. A method as claimed in claim 2, wherein a thermosetting, thermally reactive adhesive film is applied between said backing pad and said pressure plate.

4. A method as claimed in claim 3, wherein said backing pad comprising a single layer of rubber material is selected from the group consisting of neoprene, SBR, and natural rubber.

5. A method as claimed in claim 4, wherein said adhesive film is comprised of a rubber material.

6. A method as claimed in claim 3, wherein said pressure plate, said adhesive film and said backing pad exhibit almost ideally elastic behavior.

* * * * *